US006458003B1

(12) United States Patent
Krueger

(10) Patent No.: US 6,458,003 B1
(45) Date of Patent: Oct. 1, 2002

(54) DYNAMIC TRIM OF A MARINE PROPULSION SYSTEM

(75) Inventor: William R. Krueger, New Berlin, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/723,771

(22) Filed: Nov. 28, 2000

(51) Int. Cl.[7] ..... B63H 21/21
(52) U.S. Cl. ..... 440/1
(58) Field of Search ..... 440/1

(56) References Cited

U.S. PATENT DOCUMENTS

| | | | | | |
|---|---|---|---|---|---|
| 4,318,699 | A | | 3/1982 | Wenstadt et al. | 440/1 |
| 4,565,528 | A | | 1/1986 | Nakase | 440/1 |
| 4,718,872 | A | | 1/1988 | Olson et al. | 440/1 |
| 4,734,065 | A | * | 3/1988 | Nakahama et al. | 440/1 |
| 4,759,732 | A | | 7/1988 | Atsumi | 440/1 |
| 4,762,079 | A | | 8/1988 | Takeuchi et al. | 114/152 |
| 4,778,414 | A | | 10/1988 | Taguchi | 440/1 |
| 4,787,867 | A | | 11/1988 | Takeuchi et al. | 440/1 |
| 4,813,896 | A | | 3/1989 | Koike et al. | 440/61 |
| 4,824,407 | A | | 4/1989 | Torigai et al. | 440/1 |
| 4,861,292 | A | | 8/1989 | Griffiths et al. | 440/1 |
| 4,872,857 | A | * | 10/1989 | Newman et al. | 440/1 |
| 4,898,563 | A | | 2/1990 | Torigai et al. | 440/1 |
| 4,908,766 | A | | 3/1990 | Takeuchi | 364/448 |
| 4,931,025 | A | | 6/1990 | Torigai et al. | 440/1 |
| 4,939,660 | A | | 7/1990 | Newman et al. | 364/442 |
| 4,976,636 | A | | 12/1990 | Torigai et al. | 440/1 |
| 5,094,637 | A | | 3/1992 | Nakamura | 440/1 |
| 5,118,315 | A | | 6/1992 | Funami et al. | 440/1 |
| 5,142,473 | A | | 8/1992 | Davis | 364/424.01 |
| 5,167,546 | A | | 12/1992 | Whipple | 440/1 |
| 5,169,348 | A | | 12/1992 | Ogiwara et al. | 440/1 |
| 5,171,172 | A | | 12/1992 | Heaton et al. | 440/1 |
| 5,203,727 | A | | 4/1993 | Fukui | 440/1 |
| 5,352,137 | A | * | 10/1994 | Iwai et al. | 440/1 |
| 5,433,634 | A | * | 7/1995 | Nakayama et al. | 440/1 |
| 5,507,672 | A | * | 4/1996 | Imaeda et al. | 440/1 |

* cited by examiner

*Primary Examiner*—Sherman Basinger
(74) *Attorney, Agent, or Firm*—Fletcher, Yoder & Van Someren

(57) ABSTRACT

A method and system for defining a program to control the trim position of a propulsion unit mounted on a watercraft for a desired utility mode. Also, a method and system for controlling the trim position in a given utility mode by using the defined program. In defining the program, a first utility mode is defined and the watercraft is operated in the defined mode as in normal operation. Multiple trim positions are selected throughout the course of operation in the defined mode. For each selected trim position, an operational parameter of the watercraft is sensed. Multiple values of the same parameter may be sensed and measured for a single trim position. After the parameters have been sensed for each trim position, a correlated data set is created. A correlated data set is saved to a memory device for each selected trim position of the defined utility mode. In controlling the trim position, the watercraft is again operated in the first utility mode. A current operational parameter is then measured. Having measured the current operational parameter, the correlated data sets are recalled from memory so that the current operational parameter may be compared with the stored parameters in the data sets. The trim position is then selected and set based on the comparison of the current parameter with those stored in the data set.

30 Claims, 3 Drawing Sheets

DYNAMIC TRIM OF A MARINE PROPULSION SYSTEM

BACKGROUND OF THE INVENTION

1. Field of the Invention

The present invention relates generally to the field of propulsion systems for watercraft, such as fishing boats, ski boats, and other pleasure and utility craft. More specifically, the present invention relates to trim control of the propulsion unit in accordance with a defined utility of the watercraft.

2. Description of the Related Art

Recreational watercraft are extremely popular for a variety of uses. Some of the more typical uses may include water skiing, other suitable towing activities, fishing, or simple pleasure riding. All of these activities require the ability of a propulsion system to move the watercraft through the water by providing an adequate amount of thrust.

One conventional approach to providing thrust for a watercraft is the use of an internal combustion engine power source in an outboard or an inboard motor. The motor is typically mounted at the stem of the boat. An outboard motor is typically mounted to the transom of the boat and is drivingly engaged to a prop. Alternatively, an inboard motor is typically housed in the hull of the watercraft while drivingly coupled to a prop located outside the hull. The prop is then driven or rotated by the motor to displace water and thereby to produce the required thrust.

An important component of imparting adequate thrust to the watercraft is trim control. Trim control is, essentially, the alteration of the thrust vector as produced by the prop in an angular manner about a generally horizontal axis. Change in trim allows the motor to more efficiently produce thrust at different stages of operation of the watercraft. For example, as a watercraft is accelerated from a slow pace to a cruising speed, the attitude or angular position of the boat begins to change with respect to the waterline. Likewise, other parameters change such as, for example, engine speed, fuel flow rate, etc. These factors affect the efficiency of the propulsion system as it tries to impart thrust to the watercraft. Thus, it is desirable to alter the thrust vector of the prop as boating conditions change to promote greater efficiency.

Not only do conditions inherent in the performance of the watercraft dictate a change in trim position, but so does the chosen utility of the watercraft. For example, a watercraft pulling a water-skier experiences a different set of operating parameters (i.e., boat speed, engine speed, boat attitude, fuel flow, etc.) than does a watercraft simple cruising with a light load. The chosen utility of the watercraft, including loading conditions and operating preferences, has a great effect on selecting an appropriate or desirable trim position.

Often, the trim position of a propulsion unit is set manually by an operator. Effective manual control of the trim requires careful attention to numerous operating parameters as well as experience with how those operating parameters are affected by a change in trim position. To simplify the process of controlling trim, various attempts have been made to automate the selection of a watercraft's trim position. The techniques that have been employed often deal with trying to automatically determine an optimal trim position during operation of the watercraft. These techniques can often result in what is known as position hunting. Position hunting is the consequence of an attempt to arrive at an optimal position when the desired position lies between two positions produced by an iterative incremental change. Thus, because the desired position requires a positional change smaller than the defined increment, an endless search for optimization can result. Furthermore, these techniques for optimizing trim are often based upon manufacturing or design decisions. While "optimal" is largely an objective standard defined by calculations and empirical data, subjective elements do exist. For example, one operator may consider optimal trim position to produce the best possible boat speed, regardless of the rate of fuel flow. A second operator my believe just the opposite with a desire to expend the least amount of fuel in all situations. Manufacturing and design decisions made in the process of automating trim control for "optimal" performance and do not take into account what the individual operator considers as optimal. Nor do the current techniques always consider the differing utility modes that a watercraft may experience along with the fact that each utility mode may redefine what is optimum with regard to trim position.

There is, therefore, a need in the art for a method and system of controlling the trim position of a watercraft's propulsion unit which is flexible and allows interactivity from the watercraft operator. Such a system and method should be simple to operate and allow trim settings based on either operator selection or on calculation based optimization if desired. The system and method should allow for multiple trim position settings for each utility mode of the watercraft and should allow redefinition of the trim settings with minimum effort.

SUMMARY OF THE INVENTION

The invention provides a technique for defining a program for control of the trim position of a propulsion unit mounted on a watercraft. In accordance with the technique, a first utility mode is defined and the watercraft is operated in the defined mode as it would be in normal operation. Multiple trim positions are selected throughout the course of operation in the defined mode. For each selected trim position, an operational parameter of the watercraft is sensed. Multiple values of the same parameter may be sensed and measured for a single trim position. After the parameters have been sensed for each trim position, a correlated data set is created. A correlated data set is saved to a memory device for each selected trim position of the defined utility mode.

The invention also provides a technique for control of the trim position of a propulsion unit, the technique being based upon the program defined in the above mentioned method. In accordance with the technique, the watercraft is again operated in the first utility mode. A current value of the operational parameter is then measured. Having measured the current value of the operational parameter, the correlated data sets are recalled from memory so that the current value may be compared with the stored values in the data sets. The trim position is then selected and set based on the comparison of the current value with those stored in the data set.

The invention also provides a system for controlling the trim position of a propulsion unit mounted on a watercraft. A first sensor is deployed for determination of the trim position. A second sensor is deployed for sensing an operational parameter of the watercraft. A switch is provided for defining a utility mode in which the watercraft will be operated. A processor, such as a microprocessor or other digital circuitry, is coupled to the switch, the first sensor and the second sensor. The processor is adapted to correlate a set of information including the determined position of the propulsion unit with the sensed operational parameter. A memory device is coupled to the processor for storage of the information set allowing subsequent recall of the information.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
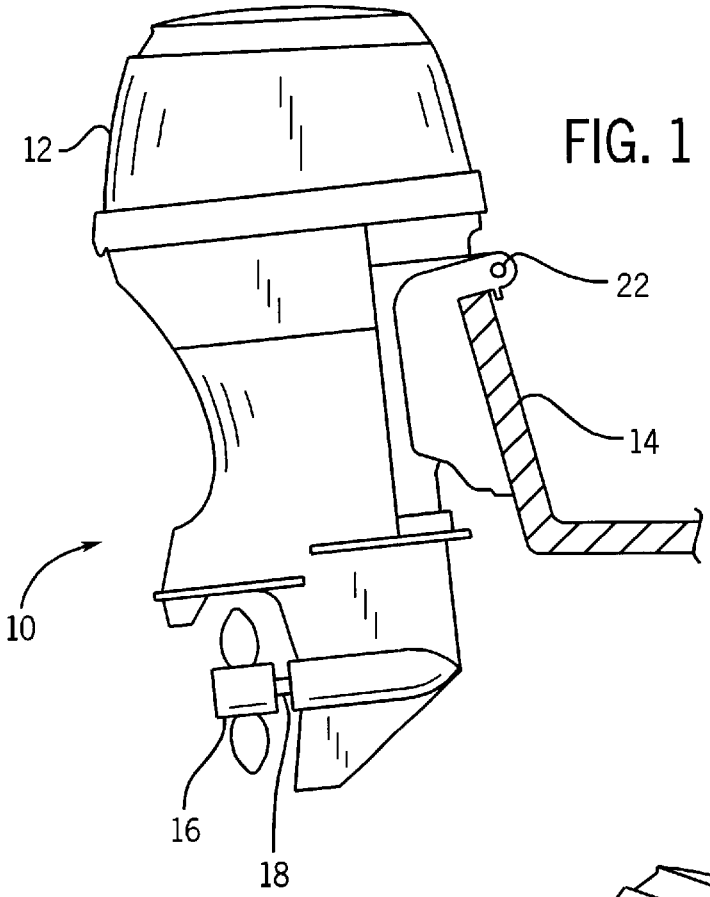
FIG. 1 is an elevational view of the aft section of a watercraft showing a propulsion system in a first position.

Turning now to the drawings and referring first to FIG. 1, a propulsion unit for a watercraft is shown in a first trim position 10. The propulsion unit is depicted as an outboard motor 12, but other propulsion devices are contemplated as being used in the presently disclosed technique. For example, the present technique is equally applicable to an inboard motor. The outboard motor 12 is attached to the transom 14 of a watercraft. The outboard motor 12 includes a prop 16 for producing thrust to motivate the watercraft through a body of water. The outboard motor 12 typically includes an internal combustion engine and power transmission components (none shown) coupled to the proper 16 by means of a shaft 18. The manner of producing and transmitting power to the prop is well known to those skilled in the art and is, therefore, not discussed in detail herein. It is noted that the outboard motor 12 is positioned such that the prop 16 is inward adjacent the transom 14 and is angled such that a generally horizontal, but slightly upward thrust, will be imparted to the rear of the watercraft. This position is often referred to as the trimmed in position.

Figure 2:
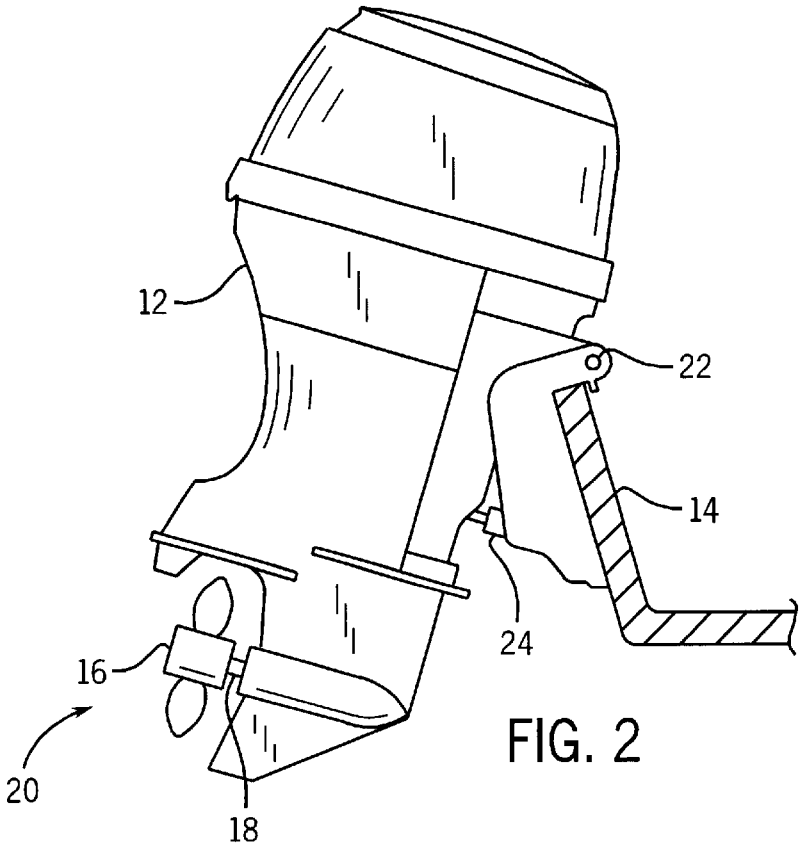
FIG. 2 is an elevational view of the aft section of a watercraft showing a propulsion system in a second position.

Referring to FIG. 2, the same propulsion device is shown in a second trim position 20. The outboard motor 12 is shown to be positioned such that the prop 16 is displaced from the transom 14 and is angled in a manner to impart a slightly downward thrust at the rear of the watercraft. This position is often referred to the trimmed out position. The outboard motor 12 may be angularly positioned in various orientations between the trimmed in and trimmed out positions. The outboard motor 12 shown in FIGS. 1 and 2 rotates about a pivoting member 22 allowing it to achieve various trim positions within the defined range. An actuator 24 provides the mechanical force to move the outboard motor 12 from one trim position to another and also maintain the outboard motor in a selected position. The actuator 24 may be any known actuator typically used for accomplishing such positioning, but is shown in FIG. 2 to be a hydraulic cylinder.

While not shown in the drawings, another component often associated with trim position is a lift component. The lift of an outboard motor 12 simply refers to the vertical displacement of the motor with respect to the watercraft itself. Lift may be largely independent of any angular change in the thrust vector produced by the prop 16. The control of the lift component may be controlled independently of the trim, but is often combined with the trim control because of the interrelated nature of the two components. Thus, in context of this disclosure, any reference to control of the trim position is considered to be applicable to the control of the lift component, whether controlled separately or together.

It is further noted that, in the case of an inboard motor, the motor would be disposed within the hull of the watercraft with the prop being disposed outside the hull. In such an instance, the entire motor would not rotate to alter trim position as does the outboard motor of FIGS. 1 and 2. Instead, the motor would remain fixed and the prop would independently rotate about an axis. A much smaller arc of rotation would result and the prop, while changing the angular direction of thrust, would not be displaced away from the transom as discussed above in reference to the prop 16 shown in FIGS. 1 and 2. The technique disclosed below herein would be equally applicable to such a configuration.

Figure 3:
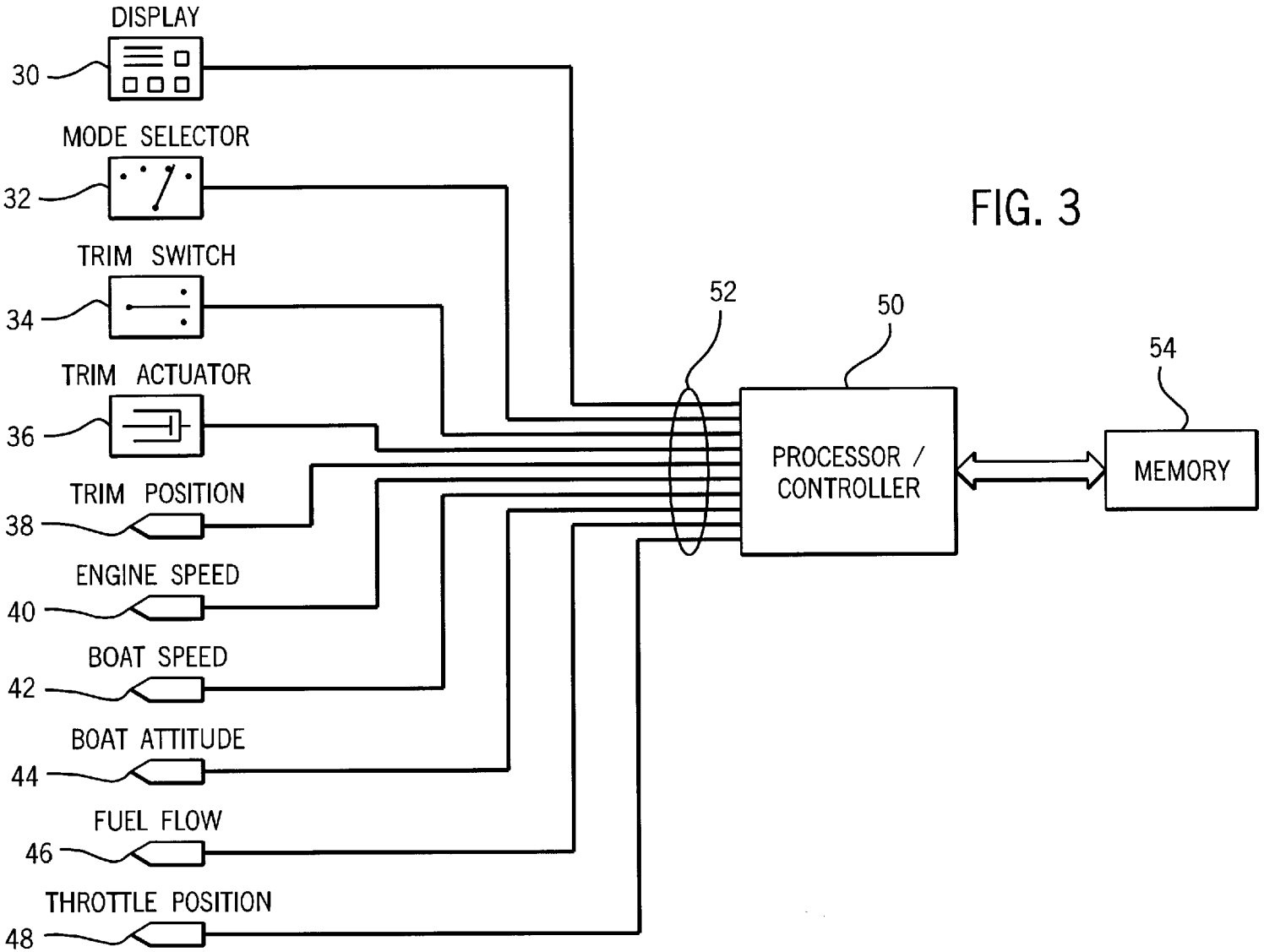
FIG. 3 is a schematic diagram according to one embodiment of the present invention.

Turning now to FIG. 3, a schematic diagram is shown representing various components which may be employed with the present technique. A display 30 may be located in proximity to a defined operator area on the watercraft. The display 30 may be of the type which exhibits text, visual graphics, or both. The display might be an LCD type display, or a simple set of LED's. The display is utilized to convey information deemed helpful to the operator during operation of the watercraft and during implementation of the present technique. A mode selector 32 allows an operator to define and select utility modes which the watercraft will be operated in. For example, the mode selector 32 may be set to a first mode which corresponds with a water-skiing or towing mode. The mode selector may be subsequently set to a second mode which might correspond with a cruising mode under light load conditions. Multiple modes are available for selection and each may be defined for an individual utility of the watercraft as shall be discussed in greater detail below. The mode selected by the operator may be indicated on the display 30 to confirm which mode is currently being employed (or defined/programmed as discussed below).

A trim switch 34 allows an operator to select the trim position of a propulsion device by activating a trim actuator 36. After receipt of an appropriate signal from the trim switch 24, the trim actuator will alter the trim position of the propulsion unit within the defined range. A first sensor 38 may be employed to determine the current trim position of the propulsion unit. However, it may be possible with an appropriate bus and processors to continually track the trim position of the propulsion unit without the need for a sensor. Likewise, various other sensors might be eliminated with the appropriate configuration. However, for sake of simplicity and understanding, the technique is shown and discussed here with the use of sensors. Additional sensors may be employed with the disclosed technique. These may include, by way of example, a sensor for determining engine speed 40, boat speed 42, boat attitude 44, meaning the angle of the boat with respect to the horizon, fuel flow 46, and/or throttle position 48.

Each of the above components are coupled to a microprocessor 50 or other digital processing circuitry for control of the combined system. The components may be coupled to the microprocessor by individual wiring harnesses 52 as depicted, or by a common bus. A common bus may be employed such as in a control area network. Among other advantages, this would provide a common wiring harness for simplifying integration of new and alternative components if desired. The processor 50 is also coupled to, or in communication with a memory device 54 for storing programs, routines, or data as needed. The processor 50 and memory 54 may be dedicated to the system employed by the present technique, or they may be existing hardware found on a watercraft such as an electronic control unit used in controlling the propulsion system.

Figure 4:
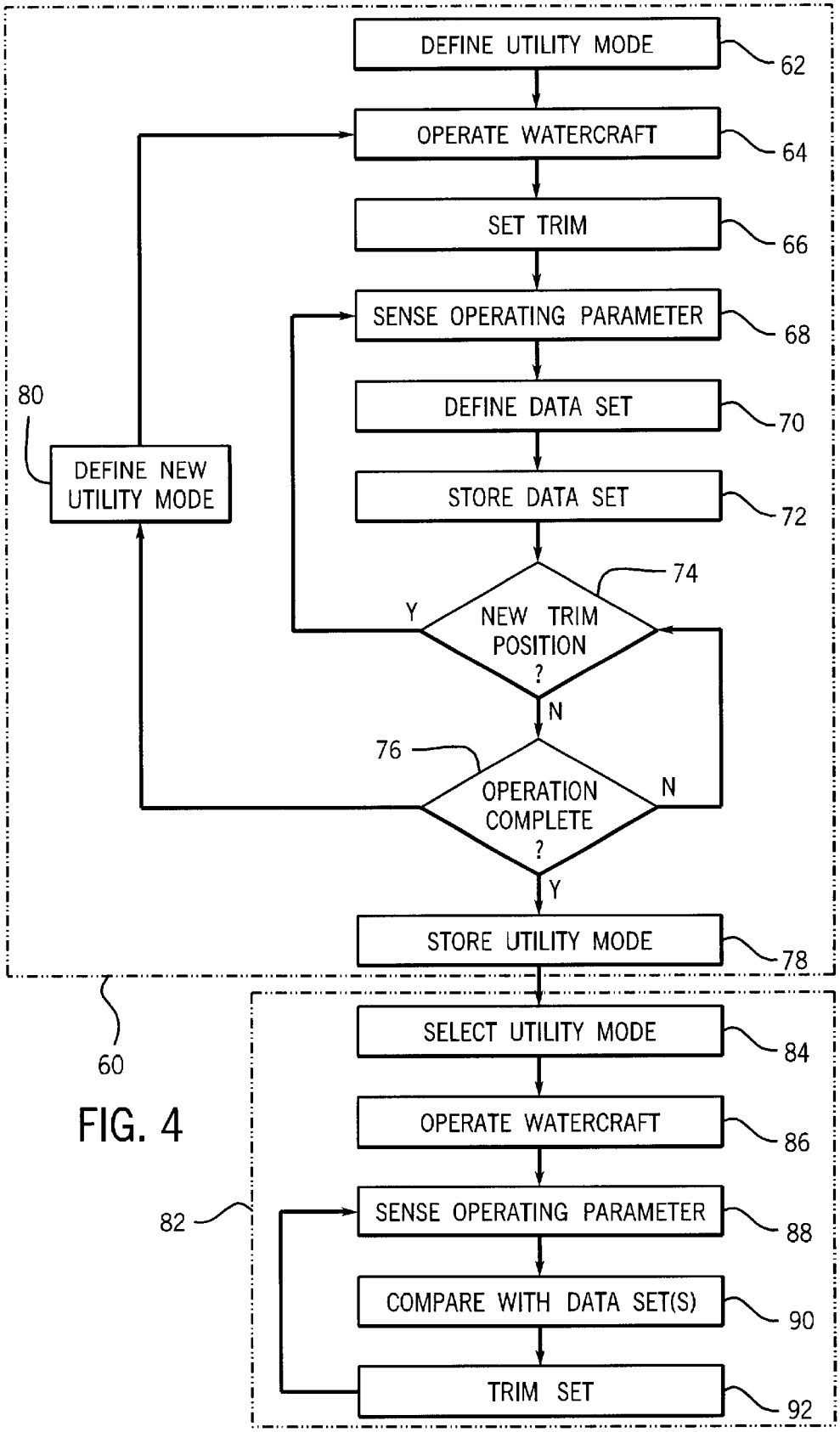
FIG. 4 is a logic sequence according to one embodiment of the present invention.

Turning now to FIG. 4, and also referring to FIG. 3, the logic and operation of the present technique will now be discussed. FIG. 4 shows the logic for defining a trim control program, as indicated generally at reference numeral 60. At step 62 a utility mode is defined. The act of defining a utility mode entails setting the mode selector 32 to the desired channel or mode. Depending on the specific embodiment being utilized, this may also entail interaction with the display 30, using an appropriate input device, to appropriately name the current mode. For example, in preparation to perform the technique, an operator will select a first channel or mode with the mode selector 32 and then, if preparing to pull a skier, name the utility mode as "Skiing." Alternatively, the operator may simply leave the name as a default name such as "Mode 1." The utility mode is now defined and the watercraft will be operated in the defined mode as indicated at 64. In the example used above, the watercraft would now be operated in accordance with pulling a water-skier. In association with operating the watercraft in the defined mode, the trim will be set at a selected position 66. The trim may be set by the operator using the trim switch 34 which will in turn activate the trim actuator 36 to set and maintain the desired trim position. Once the trim is set, an operating parameter is sensed as indicated at 68. The operating parameter may be engine speed 40, boat speed 42, boat attitude 44, fuel flow 46, throttle position 48, or an appropriate combination of such parameters. It is noted that the parameters shown in FIG. 3 are not to be considered exclusive or limiting in any way. Rather, any operational parameter of the watercraft may be utilized so long as it can be appropriately correlated with the trim position of the propulsion unit.

In continuing with the example discussed above, the parameter being sensed may be engine speed 40. Thus, for the selected trim position, the engine speed will be sensed and monitored. This may include measuring multiple values of the engine speed while the propulsion unit remains in the selected trim position. After sensing and monitoring the engine speed, a data set is defined as indicated by step 70. This data set will include the selected trim position as well as the measured value or values of the operating parameter. In our example, the measured engine speed, or a range of measured values of the engine speed, would be stored in association with the selected trim position as a correlated data set. The correlation of the data set would be handled by the processor 50 and the data set would subsequently be stored in the memory 54 as indicated at 72. New trim positions will be monitored using the trim position sensor 38 as indicated at decision step 74. If a new trim position is set then the process returns to step 68 where the operating parameter is monitored again in association with the new trim position. Again, a data set will be compiled for the new trim position as indicated at 70 and the data set stored in the memory as shown at 72. This process becomes iterative for the multiple trim positions which may be selected.

If a new trim position is not selected a determination will be made as to whether operation of the watercraft is complete for the defined mode as shown at 76. This may be accomplished by monitoring for an operator input which ends the operation, or by monitoring for a default event such as sensing a predetermined minimum value for the sensed operating parameter, i.e., a minimum engine speed. If the operation is complete then all the data sets are stored to correspond with the defined utility mode as indicated at 78. If however, operation of the watercraft is not complete, then the process returns to the step at 74 of monitoring for a change in the trim position of the propulsion unit. Once the utility mode is stored 78, a new utility mode may be defined as indicated at 80, and the above described process may be repeated for the new utility mode.

FIG. 4 also shows the logic for controlling the trim position of a propulsion unit, as indicated generally at 82, based upon a program defined according the logic shown at 60. First, a programmed utility mode is selected as indicated at 84. For example, the "Skiing"/"Mode 1" utility mode defined above might be selected in preparation for towing a skier. As shown at 86, the watercraft will then be operated as it would at any other time while pulling a skier except that the trim position will now be controlled according the process described below. The operating parameter previously used in programming the utility mode is then sensed and monitored as shown at 88. Again, in using the example from above, the engine speed is monitored. The stored data sets are then recalled from memory so that the current value of the operating parameter may be compared to those stored in the data sets as indicated at 90. If multiple values of a parameter have been stored as a range for a given trim position, the current value will be compared with the data sets to determine within which range it falls. After this comparison is made the associated trim position of the appropriate range is ascertained from the data set and the trim position is selected and set accordingly, as indicated at step 92. The process then returns to step 88 with steps 88, 90 and 92 becoming iterative during the operation of the watercraft. A second programmed utility mode may be selected at a later time and the entire process repeated for the second mode.

While the example above was specific, in that it utilized operator selected trim positions and engine speed as a sensed operating parameter, it is to be considered illustrative only. Numerous variations of the technique are deemed to be acceptable. Indeed, any of the mentioned operating parameters may be utilized instead of engine speed, or multiple parameters may be used in combination to create a more complex correlated data set. Furthermore, the data sets may be combined and compiled to produce a curve or profile based on the measured values in the data sets. The curve could then be referenced to provide a smoothing function with regard to transitioning from one trim position to another. Also, while the trim position was described as being operator defined, some other optimization method might be utilized to set the trim positions during the programming of each individual utility mode.

In addition to what has been described above, various functional features may be added to enhance the technique. For example, in sensing one or more operating parameters, these values may be utilized for calculation of a performance characteristic such as an efficiency rating. The efficiency rating may be for fuel efficiency, engine output, or some other operating characteristic. The performance rating may then be shown on the display 30 for the operator to view and consider during operation of the watercraft. This may be particularly advantageous during the programming of a utility mode 60.

Another feature to enhance the technique is to allow the operator to redefme one or more of the data sets during normal operation of the watercraft (i.e., at times other than during programming as shown at 60). This would likely be accomplished by having an additional switch (not shown) coupled to the processor 50. To redefine a data set, the operator would manually override a selected trim position by setting the propulsion unit to a new trim position. By activating such a switch, the new trim position would now replace the old trim position in the data set. Alternatively, a new data set might be created for the new trim position by following a similar procedure to that described above. This could be accomplished without having to redefine to entire utility mode program thus allowing the operator to "ouch up" existing programmed utility modes.

The foregoing technique may be adapted to many different applications and operating conditions, particularly those which occur or are desired repeatedly. For example, for rapid or high performance operation of a boat, the motor trim may require frequent or relatively quick changes, such as when speed increases quickly. A programmed mode may accommodate such operation by monitoring and then repeating the same or similar trim settings depending upon boat speed, throttle position, or other inputs. Similarly, when pulling a skier, a user may desire to change trim at the boat picks up speed or changes attitude, such as corresponding to a point when the skier has begun to plane.

Other modifications may also be made to the foregoing procedure, such as to optimize trim or specific operating parameters, or to smooth changes in trim. For example, at times the operator may wish to set the speed and trim for extended durations, such as during transport over a lake or river. A corresponding mode may be set to optimize fuel consumption (such as based on changes in fuel level, monitored fuel delivery, known engine mapping, and so forth). The system controller may then accept a user-defined trim, or may seek an optimal trim at step 66 described above, to provide the best available fuel consumption for the speed selected by the operator. Moreover, where the foregoing procedure results in several changes in trim being made during the course of operation in a mode, such as during acceleration or deceleration, an additional step may be added in which the changes are made continuous or quasi-continuous, such as by curve fitting or low pass filtering the trim settings over the period of operation.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method for defining a program for control of the trim position of a propulsion unit mounted on a watercraft, the method comprising the acts of:

(a) defining a first utility mode and operating the watercraft in the first utility mode;

(b) selecting multiple trim positions of the propulsion unit;

(c) sensing an operational parameter of the watercraft in association with each selected trim position and defining a correlated data set for each trim position; and (d) saving to a memory device the correlated data set for each selected trim position in the first utility mode.

2. The method of claim 1, wherein act (c) includes measuring multiple values of the sensed operational parameter for each selected trim position and wherein the correlated data set includes an associated range of the measured values.

3. The method of claim 1 wherein each trim position is defined by an operator of the watercraft.

4. The method of claim 1 wherein each trim position is selected to be an optimal trim position with respect to respective correlated reference parameter.

5. The method of claim 1 wherein act (c) includes sensing the engine speed of the propulsion unit.

6. The method of claim 1 wherein act (c) includes sensing the speed of the watercraft.

7. The method of claim 1 wherein act (c) includes sensing an angular position of the watercraft with respect to the horizon.

8. The method of claim 1 wherein act (c) includes sensing a throttle position.

9. The method of claim 1 wherein act (c) includes sensing a rate of fuel flow to the propulsion unit.

10. The method of claim 1 further comprising the acts of defining an additional utility mode and operating the watercraft in the second utility mode, repeating acts (b) and (c) and saving to a memory device each selected trim position and correlated reference parameter for defining the trim position during subsequent operation of the watercraft in the additional utility mode.

11. A method for controlling the trim position of a propulsion unit mounted on a watercraft, the method comprising the acts of:

(a) defining a first utility mode and operating the watercraft in the first utility mode;

(b) selecting multiple trim positions of the propulsion unit;

(c) sensing an operational parameter of the watercraft in association with each selected trim position and defining a correlated data set for each trim position;

(d) saving to a memory device the correlated data set for each selected trim position in the first utility mode;

(e) operating the watercraft again in the first utility mode;

(f) sensing a current operational parameter;

(g) recalling from memory the multiple trim positions with their respective correlated data sets;

(h) comparing the correlated data sets with the current operational parameter; and (i) defining a trim position based upon the comparison of the correlated data set with the current operational parameter.

12. The method of claim 11, wherein act (c) includes measuring multiple values of the sensed operational parameter for each selected trim position and wherein the correlated data set includes an associated range of the measured values.

13. The method of claim 12, wherein act (h) includes comparing the current operational parameter with the range of measured values in the data set.

14. The method of claim 11 wherein each trim position selected in act (b) is defined by an operator of the watercraft.

15. The method of claim 11 wherein each trim position selected in act (b) is selected to be an optimal trim position with respect to respective correlated reference parameter.

16. The method of claim 11 wherein act (c) includes sensing the engine speed of the propulsion unit.

17. The method of claim 11 wherein act (c) includes sensing the speed of the watercraft.

18. The method of claim 11 wherein act (c) includes sensing an angular position of the watercraft with respect to the horizon.

19. The method of claim 11 wherein act (c) includes sensing a throttle position.

20. The method of claim 11 wherein act (c) includes sensing a rate of fuel flow to the propulsion unit.

21. The method of claim 11 further comprising the acts of calculating a performance characteristic of the watercraft based on the trim position and the correlated reference parameter.

22. The method of claim 21 wherein the performance characteristic is an efficiency rating of the watercraft.

23. A system for controlling the trim position of a propulsion unit mounted on a watercraft, the system comprising:

a trim position sensor wherein a position of the propulsion unit is determined;

a second sensor for sensing an operational parameter of the watercraft;

a switch for defining a utility mode in which the watercraft will be operated; and a processor coupled to the switch, the second sensor and the trim position sensor wherein the processor correlates a set of information including the determined position of the propulsion unit with the sensed operational parameter; and a memory device coupled to the processor wherein the set of information is stored for subsequent recall.

24. The system of claim 23 wherein the second sensor senses the engine speed of the propulsion unit.

25. The system of claim 23 wherein the second sensor senses the speed of the watercraft.

26. The system of claim 23 wherein the second sensor senses an angular position of the watercraft with respect to the horizon.

27. The system of claim 23 wherein the second sensor senses a throttle position.

28. The system of claim 23 wherein the second sensor senses a rate of fuel flow to the propulsion unit.

29. The system of claim 23 further comprising an operator input device adapted to be coupled to and control a trim adjustment mechanism.

30. The system of claim 23 further comprising a display coupled to the processor wherein the display conveys information regarding a selected utility mode to an operator.

* * * * *